US010349734B2

(12) United States Patent
Xavier et al.

(10) Patent No.: US 10,349,734 B2
(45) Date of Patent: Jul. 16, 2019

(54) ADJUSTABLE BRUSH TREATMENT DEVICE

(71) Applicant: Practk LLC, Fort Lauderdale, FL (US)

(72) Inventors: Simone Rodrigues Oliveira Xavier, Fort Lauderdale, FL (US); Rene Xavier Filho, Fort Lauderdale, FL (US)

(73) Assignee: Practk LLC, Fort Lauderdale, FL (US)

( * ) Notice: Subject to any disclaimer, the term of this patent is extended or adjusted under 35 U.S.C. 154(b) by 53 days.

(21) Appl. No.: 15/136,568

(22) Filed: Apr. 22, 2016

(65) Prior Publication Data

US 2017/0303677 A1 Oct. 26, 2017

(51) Int. Cl.
*A46B 1/00* (2006.01)
*A46B 5/04* (2006.01)
(Continued)

(52) U.S. Cl.
CPC ..... *A46B 17/06* (2013.01); *A41D 13/08* (2013.01); *A46B 1/00* (2013.01); *A46B 5/04* (2013.01); *A46B 9/02* (2013.01); *A46B 9/06* (2013.01); *B08B 1/001* (2013.01); *B44D 3/006* (2013.01); *A41D 2600/20* (2013.01); *A46B 2200/1046* (2013.01)

(58) Field of Classification Search
CPC ..... B44D 3/006; A47L 25/00; A47L 25/08; A47L 13/18; A01K 13/00; A01K 13/001; A01K 13/002; A46B 1/00; A46B 3/005; A46B 3/04; A46B 3/20; A46B 3/22; A46B 5/0004; A46B 5/0008; A46B 5/0016; A46B 5/04; A46B 9/00; A46B 9/02; A46B 9/023; A46B 9/06; A46B 15/00; A46B 17/06; A46B 2200/104; A46B 2200/1093; A46B 2200/3053; A46B 2200/30; A41D 13/081; A41D 2600/20
USPC .... 2/16, 20, 161.6, 161.8; 15/105, 106, 110, 15/104.5, 227, 142, 160, 186–188; 119/611–617, 625, 633
See application file for complete search history.

(56) References Cited

U.S. PATENT DOCUMENTS 61,841 A 2/1867 Lewis
415,026 A * 11/1889 Cowen et al. ..... 15/188
(Continued)

FOREIGN PATENT DOCUMENTS

CN 2448274 Y 9/2001
CN 2868178 Y 2/2007
(Continued)

OTHER PUBLICATIONS

Extended European Search Report for European Patent Application No. 16194837.7, dated May 15, 2017 (4 pages).
(Continued)

*Primary Examiner* — Mark Spisich
(74) *Attorney, Agent, or Firm* — Dorsey & Whitney LLP

(57) ABSTRACT

An adjustable brush treatment device has a flexible attachment between two lobes or textured portions. Each portion has a textured surface adapted for rinsing or cleaning cosmetic brushes, and an opposite surface adapted for placement of the device in a working area with the textured surfaces presented for engagement with a brush head or applicator. A tab or coupling member is provided for coupling the device about a user's hand, with the textured surfaces presented on opposite sides.

21 Claims, 6 Drawing Sheets

(51) Int. Cl.

| | |
|---|---|
| ***A46B 17/06*** | (2006.01) |
| ***B44D 3/00*** | (2006.01) |
| ***A41D 13/08*** | (2006.01) |
| ***A46B 9/06*** | (2006.01) |
| ***B08B 1/00*** | (2006.01) |
| ***A46B 9/02*** | (2006.01) |

(56) References Cited

U.S. PATENT DOCUMENTS 456,085 A 7/1891 Wallace et al.
530,386 A 12/1894 Boeckh
634,570 A 10/1899 Briggs
816,793 A 4/1906 Harris
926,462 A * 6/1909 Blowers ..... 119/612
1,209,763 A 12/1916 Rosengren
1,279,855 A 9/1918 Garvey
1,359,650 A 11/1920 Amis
1,491,016 A * 4/1924 McGowan ..... A61H 7/003 15/188
1,559,114 A 10/1925 Maranville
1,657,784 A 1/1928 Bergstrom
1,782,502 A 11/1930 Crane
1,877,527 A 9/1932 Moran
1,884,659 A 10/1932 Gould
1,885,572 A 11/1932 Wood
1,910,647 A * 5/1933 Steeg ..... A45D 26/0004 132/333
1,979,130 A 10/1934 Wiley
1,984,183 A 12/1934 Gillespie
2,187,430 A 1/1940 Olmsted et al.
2,263,119 A 11/1941 Cornell
D132,564 S 5/1942 Lindfelt
2,325,903 A 8/1943 Blair et al.
2,413,325 A * 12/1946 Horton ..... A45D 26/0004 2/20
2,485,068 A 10/1949 Santana
2,880,436 A 4/1959 Hayden
2,963,150 A 12/1960 Dgetluck
2,984,095 A * 5/1961 Bass ..... D06F 1/00 15/227
D193,090 S 6/1962 Kraines et al.
3,255,462 A 6/1966 Antonious
3,325,847 A 6/1967 Meranto
3,513,061 A 5/1970 Vinicki
3,648,320 A 3/1972 Woolley
3,749,233 A 7/1973 McCormick, Jr.
3,798,698 A 3/1974 Conklin, Jr.
4,040,390 A * 8/1977 Rosenbaum ..... A01K 13/002 119/631
4,129,918 A 12/1978 Lee
4,154,883 A 5/1979 Elias
D256,181 S 8/1980 Kupperman et al.
D258,968 S 4/1981 Adler
D270,582 S 9/1983 Pietrocola
4,457,640 A 7/1984 Anderson et al.
4,494,267 A 1/1985 Fredley
4,621,388 A 11/1986 Ortolivo
D301,422 S 6/1989 Schmidt
4,847,939 A 7/1989 Derencsenyi et al.
4,871,074 A 10/1989 Bryson et al.
D304,512 S 11/1989 Byers et al.
D312,340 S 11/1990 McCugh
4,980,943 A 1/1991 Barber
5,022,093 A 6/1991 Hall
D324,541 S 3/1992 Dudley
D326,750 S 6/1992 Druzek
5,322,056 A 6/1994 Menghi et al.
D354,989 S 1/1995 West
5,427,239 A 6/1995 Hunt
5,441,355 A 8/1995 Moore
D363,577 S 10/1995 Brightbill et al.
D363,606 S 10/1995 Abrahamson
5,543,194 A 8/1996 Rudy
D375,630 S 11/1996 Oliver
5,687,444 A 11/1997 Hakker
5,729,858 A 3/1998 Riffel et al.
5,815,840 A 10/1998 Hamlin
D401,971 S 12/1998 Chang
D406,680 S 3/1999 Hakker
5,898,942 A 5/1999 Anderson
6,018,837 A 2/2000 Andreu
6,058,882 A 5/2000 Leutholt
D429,860 S 8/2000 Denney
D439,386 S 3/2001 Denney
6,199,695 B1 3/2001 Takeo
6,264,391 B1 7/2001 Kroha
D446,616 S 8/2001 Denney
6,275,995 B1 8/2001 Le Gette et al.
6,460,190 B1 10/2002 Blum
D468,193 S 1/2003 Ohm et al.
6,560,813 B2 5/2003 Brown et al.
6,581,211 B1 6/2003 Golden
D477,690 S 7/2003 Howell et al.
6,669,657 B1 12/2003 Ongwela
D488,601 S 4/2004 Solanky et al.
6,752,267 B2 6/2004 MacPherson et al.
D492,816 S 7/2004 Bergquist et al.
6,811,338 B1 11/2004 Manske, Jr. et al.
D511,941 S 11/2005 McGuyer
D514,765 S 2/2006 Dretzka
D517,753 S 3/2006 Northrop
D523,192 S 6/2006 Northrop
D526,096 S 8/2006 Kaposi
D528,251 S 9/2006 Lion et al.
7,117,536 B2 10/2006 Burnett et al.
RE39,388 E 11/2006 DeBartolo
7,140,061 B2 11/2006 Baker et al.
D537,997 S 3/2007 Plikuhn
7,210,171 B2 5/2007 Jacobs et al.
D544,264 S 6/2007 Gallagher
D544,665 S 6/2007 Keene
7,234,170 B2 6/2007 Simic
D554,331 S 11/2007 Matis
D556,967 S 12/2007 Martins et al.
D560,048 S 1/2008 Snell
D569,578 S 5/2008 Yan
D581,120 S 11/2008 Sofy et al.
D603,563 S 11/2009 Cho
D609,916 S 2/2010 Benson et al.
D609,917 S 2/2010 Benson et al.
D610,753 S 2/2010 Moskowitz
7,681,250 B2 3/2010 Friedstrom
7,707,654 B1 5/2010 Spence
D625,482 S 10/2010 Yang et al.
7,823,245 B2 11/2010 Firouzman
D646,034 S 9/2011 Scott et al.
D650,522 S 12/2011 Gundersen
D651,408 S 1/2012 Farkas
D662,292 S 6/2012 Meynard
D665,548 S 8/2012 Arvinte et al.
D667,187 S 9/2012 Sowinski et al.
8,356,378 B1 1/2013 Crooms
8,371,044 B2 2/2013 Rusnak
D685,560 S 7/2013 Lee et al.
D687,623 S 8/2013 Norris
D700,400 S 2/2014 Saman
D701,000 S 3/2014 DiGirolamo et al.
8,677,544 B1 3/2014 Raven et al.
D702,886 S 4/2014 Bohman
D703,409 S 4/2014 Robbins, III et al.
8,689,387 B2 4/2014 Gundersen
D707,005 S 6/2014 Levy et al.
D712,610 S 9/2014 Arvinte et al.
9,015,895 B2 4/2015 Filho et al.
D746,010 S 12/2015 Xavier et al.
D747,628 S 1/2016 Kowalczyk
9,345,316 B2 5/2016 Filho et al.
D758,666 S 6/2016 Carrillo et al.
D764,709 S 8/2016 Filho et al.
D766,511 S 9/2016 Filho et al.
D767,226 S 9/2016 Albers et al.
9,474,361 B2 10/2016 Filho et al.
D779,140 S 2/2017 Lim et al.

(56) References Cited

U.S. PATENT DOCUMENTS

| | | | |
|---|---|---|---|
| D782,138 | S | 3/2017 | Xavier et al. |
| D782,763 | S | 3/2017 | Xavier et al. |
| D782,764 | S | 3/2017 | Xavier et al. |
| D783,913 | S | 4/2017 | Maitland et al. |
| D789,611 | S | 6/2017 | Xavier et al. |
| D793,016 | S | 7/2017 | Fakier |
| D795,516 | S | 8/2017 | Logan et al. |
| D802,237 | S | 11/2017 | Huang et al. |
| 2001/0042281 | A1 | 11/2001 | Forsline |
| 2003/0204927 | A1 | 11/2003 | Kelly |
| 2004/0025084 | A1 | 2/2004 | Krueger |
| 2004/0250840 | A1 | 12/2004 | Baker et al. |
| 2005/0166301 | A1 | 8/2005 | Tweel et al. |
| 2005/0177965 | A1 | 8/2005 | Edoh |
| 2006/0191092 | A1 | 8/2006 | O'Reilly et al. |
| 2006/0272116 | A1 | 12/2006 | Thompson |
| 2007/0048063 | A1 | 3/2007 | Bauer et al. |
| 2007/0056130 | A1 | 3/2007 | Baker et al. |
| 2007/0118963 | A1 | 5/2007 | Snyder |
| 2007/0151573 | A1 | 7/2007 | Christian |
| 2007/0277288 | A1 | 12/2007 | Sing et al. |
| 2008/0109933 | A1 | 5/2008 | Dolenak |
| 2008/0178366 | A1 | 7/2008 | Daher |
| 2008/0244848 | A1 | 10/2008 | Firouzman |
| 2008/0283078 | A1 | 11/2008 | Dumler et al. |
| 2009/0139007 | A1 | 6/2009 | Bevier |
| 2010/0192318 | A1 | 8/2010 | Huizinga |
| 2010/0218326 | A1 | 9/2010 | Yamaguchi |
| 2011/0041276 | A1 | 2/2011 | Edwards et al. |
| 2012/0023693 | A1 | 2/2012 | Pung et al. |
| 2012/0060312 | A1 | 3/2012 | Kubes |
| 2014/0289987 | A1 | 10/2014 | Filho et al. |
| 2015/0027495 | A1 | 1/2015 | Xavier et al. |
| 2015/0027496 | A1 | 1/2015 | Xavier et al. |

FOREIGN PATENT DOCUMENTS

| | | | |
|---|---|---|---|
| CN | 201441347 | U | 4/2010 |
| CN | 101856156 | A | 10/2010 |
| DE | 20102840 | U1 | 6/2001 |
| EP | 2682035 | A2 | 1/2014 |
| FR | 1162308 | A | 9/1958 |
| FR | 2245476 | * | 4/1975 |
| FR | 2443243 | * | 7/1980 |
| JP | 10-165353 | * | 6/1998 |
| JP | 2003-199621 | * | 7/2003 |
| JP | 2004-249061 | * | 9/2004 |
| JP | 2009-189640 | * | 8/2009 |
| KR | 200422216 | Y1 | 7/2006 |
| SE | 62075 | | 11/1997 |
| WO | WO02/01997 | A2 | 1/2002 |
| WO | WO2011067677 | A2 | 6/2011 |

OTHER PUBLICATIONS

Target Mobile Site—Silicone Solutions Black Silicone Oven Mitt. <http://sites.target.com/site/en/spot/mobile_product_detail.jsp?tcin=568859&keywords=sili . . . Feb. 28, 2012.

Makeup Brush Washing Instructions: How & Why Clean Your Dirty Cosmetic Brushes. <http://www.freebeautytips.org/cleanbrushes.html> Apr. 2, 2012.

How to Clean Makeup Brushes Video and Steps. <http://www.realsimple.com/beauty-fashion/makeup/how-to-clean-makeup-brushes-0000000 Apr. 3, 2012.

How to Clean Makeup Brushes/Cleaning Guides. <http://www.howtocleanstuff.net/how-to-clean-makeup-brushes/ Apr. 2, 2012.

Amazon.com: Norpro Pink Silicone and Fabric Glove, Medium, from Norpro. retrieved Oct. 14, 2015 from <http://www.amazon.com/gp/product/B001FB59OA?Keywords=norpro%20glove&qid=1444835721&ref_=sr_1_1&sr=8-1>.

Norpro—Quality for the Cook. retrieved Oct. 14, 2015 from <https://web.archive.org/web/20090503194212/http://www.norpro.com/store/products/siliconefabric-oven-glove-pink>.

Norpro—Quality for the Cook. retrieved Oct. 14, 2015 from <https://web.archive.org/web/20121124064626/http://www.norpro.com/store/products/siliconefabric-oven-glove-pink>.

"2X Sigma Spa® Brush Cleaning Glove." Retrieved Dec. 14, 2015 from <https://web.archive.org/web/20140529021235/http://www.sigmabeauty.com/2X_Sigma_Spa_Brush_Cleaning_Glove_p/ssg2xs.htm>.

"Sigma SpaTM Brush Cleaning Glove." Retrieved Dec. 14, 2015 from <https://web.archive.org/web/20130220234830/http://www.sigmabeauty.com/Sigma_Spa_Brush_Cleaning_glove_p/bc001.htm?>.

My Makeup Issues: "Sigma Spa Brush Cleaning Glove—Review." Mar. 13, 2013. Retrieved Dec. 14, 2015 from <http://mymakeupissues.blogspot.com/2013/03/sigma-spa-brush-cleaning-glove-review.html>.

"Caring for your Make-Up Brushes." Basic MakeUp and Anti Aging Products. 4 pages. Obtained Oct. 27, 2011 from <http://www.basicmakeup.com/make-up-brushes/>.

"Cosmetic Brushes." Basic MakeUp and Anti Aging Products. 4 pages. Obtained Oct. 27, 2011 from <http://www.basicmakeup.com/cosmetic-brushes/>.

"Makeup Brush Cleaning." 3 pages. Obtained Oct. 27, 2011 from <http://makeup.beautyhill.com/makeup-brush-cleaning.html/>.

"The Brush Guard." 2 pages. Obtained Oct. 27, 2011 from <http://www.thebrushguard.com/use.html>.

Samanta: "New! Sigma 2X Spa Glove; the other end of the brush", May 29, 2014. Retrieved Oct. 13, 2015 from <https://theotherendofthebrush.wordpress.com/2014/05/29/new-sigma-2x-spa-glove-2/>.

Dulce Candy: "Review/Demo: 2X Sigma Spa Brush Cleaning Glove", Jun. 17, 2014. Retrieved Oct. 14, 2015 from <https://www.youtube.com/watch?v=1x04MrHPkrQ>.

The extended European Search Report dated Oct. 22, 2015 in connection with European Patent Application No. 15170663.7.

The extended European Search Report dated Sep. 11, 2015 in connection with European Patent Application No. 14197771.0.

The extended European Search Report dated Sep. 11, 2015 in connection with European Patent Application No. 14197802.3.

Office Action dated May 11, 2015 received in connection with Chinese Application No. 201310063907.8, including English translation.

Plaintiff, Prior Art Statement (Litigation Document, U.S. Pat. No. 9,015,895), dated Apr. 13, 2016.

Plaintiff, Opening Claim Chart (Litigation Document, U.S. Pat. No. 9,015,895), dated Feb. 26, 2016.

Defendants, Prior Art Statement (Litigation Document, U.S. Pat. No. 9,015,895), dated Mar. 18, 2016.

Defendants, Responsive Claim Chart (Litigation Document, U.S. Pat. No. 9,015,895), dated Mar. 18, 2016.

"Brushegg: A Compact Makeup Brush Cleaning Tool," Coffee Sundays, Article Dec. 18, 2014, retrieved Jul. 8, 2016 from <http://www.coffeesundays.com/2014/12/18/brushegg-a-compact-makeup-brush-cleaning-tool/>, 14 pages.

"Dog Grooming: Rinse Ace Bath Mitt at Drs. Foster & Smith," Review Apr. 10, 2011, retrieved Jul. 7, 2016 from <http://www.drsfostersmith.com/product/prod_display.cfm?pcatid=11101>, 4 pages.

"Makeup Brush Cleaning!" Rebekah Elizabeth, website copyright 2015, retrieved Jul. 8, 2016 from <http://rebekaheliz.com/2013/05/29/makeup-brush-cleaning/>, 5 pages.

PECO Ignores Pottstown too?, post date Jul. 1, 2010, <http://www.saveardmorecoalition.org/node/4731/peco-ignores-pottstown-too>, site visited Jul. 15, 2016, 9:57:06 PM.

Chinese Office Action for related Chinese Patent Application No. 2015104585076, dated May 4, 2017 (8 pages), English Translation.

Amazon, "Sigma Beauty Dry'n Shape," <https://www.amazon.com/Sigma-Beauty-D201-Dryn-Shape/dp/B0050CFD1O>, 7 pages, accessed Nov. 7, 2016.

Patent Examination Report No. 1 dated Nov. 25, 2016 in connection with Australian Patent Application No. 2015221549, 6 pages.

Patent Examination Report No. 1 dated Dec. 8, 2016 in connection with Australian Patent Application No. 2015221550, 7 pages.

(56) References Cited

OTHER PUBLICATIONS

First Office Action for European Patent Application No. 16194837.
7, dated Jul. 5, 2018 (5 pages).

* cited by examiner

ADJUSTABLE BRUSH TREATMENT DEVICE

BACKGROUND

The present disclosure relates generally to brushes and brush treatments, and more particularly to cleaning and rinsing cosmetic brushes and other applicators. Suitable uses include, but are not limited to, cleaning, rinsing, and removing excess moisture from brushes and applicators of different sizes and configurations.

Makeup, oils, bacteria, and other substances tend to accumulate on brushes, sponges, and similar cosmetic applicators. These accumulated substances can undesirably affect the color and quality of applied makeup, due to oxidation and binding with the oils. Unwanted accumulations can also lead to uneven application, skin irritation, and other issues. Removing the accumulated substances can thus improve both the function and the appearance of a user's cosmetic accessories, and extend their useful service life.

Cosmetic brushes were traditionally cleaned by hand, using a mixture of water and mild soap or shampoo. Previous efforts to improve upon hand washing have led to a range of products with surface textures adapted for cleaning, rinsing and removing excess moisture, including products described in U.S. Pat. No. 9,015,895, TEXTURED DEVICE FOR CLEANING COSMETIC BRUSHES, filed Jul. 2, 2012; U.S. application Ser. No. 14/514,630, MAT DEVICE FOR CLEANING COSMETIC BRUSHES, filed Oct. 15, 2014 (Publication No. 2015/0027495); and U.S. application Ser. No. 14/514,635, REVERSIBLE DEVICE FOR CLEANING COSMETIC BRUSHES, filed Oct. 15, 2014 (Publication No. 2015/0027496); each of which is incorporated by reference herein, in the entirety and for all purposes.

Although these and other existing products can be used to enhance certain aspects of brush cleaning and treatment, there remains a need for new and improved designs. In particular, there remains a need for new products and techniques that provide for a more flexible approach to brush rinsing and cleaning, and which can be readily adapted to the different treatment configurations to enhance the user experience. At the same time, there is also a need for improved products and methods that can offer these advantage without incorporating all the same features and limitations of the existing prior art.

SUMMARY

In one example, an adjustable brush treatment device includes a flexible attachment for coupling between two textured portions or lobes. Each portion has a first textured surface adapted for cleaning cosmetic brushes, and a second opposite surface adapted for placement of the device in a working area. In this first configuration, the textured surfaces are presented for washing and rinsing cosmetic brush heads and similar applicators.

Each portion of the device can have a tab or extension with coupling features adapted for coupling the device about a user's hand. In this second configuration, the textured surfaces are presented for engagement with the brush heads on opposite sides of the user's hand. Thus, the device is adaptable for use in two different working configurations, with the different textured surfaces either presented in the same direction above a working surface, or on opposite sides of the user's hand.

Methods of using such an adjustable brush treatment device include providing the device for use in either the first or second configuration, and then manipulating or adjusting the device between the two. This step can be accomplished either by removing the device from the working surface and coupling it about the user's hand, with the textured surfaces presented on either side, or by decoupling the device from the user's hand and positioning it on the working surface, with the textured surfaces presented on the same side.

In either configuration, the user can clean and rinse cosmetic brushes and applicators of different sizes and configurations by engaging the brush or applicator head against the textured surfaces, on either or both portions of the device. Depending on brush style and texture arrangement, multiple surfaces can be used to treat each brush or applicator by selecting the textures according to desired washing, rinsing and refining steps. Brushes of different sizes and configurations can also be treated on different textured surfaces of the device.

In additional examples, an adjustable brush treatment system includes first and second lobes or textured portions, each having front and back surfaces. A first textured surface is disposed on the first front surface, with textures adapted for treating cosmetic brush heads or other applicators in one or more cleaning, rinsing or refining steps. A second textured surface pattern is disposed on the second front surface, adapted for one or more additional treatment steps. The device is adjustable between a first configuration adapted for use on a working surface, and a second configuration adapted for use when held by or worn on a user's hand.

DETAILED DESCRIPTION

This application describes various examples of an adjustable brush treatment device, and corresponding methods of use. In one example, the device has a number of textured surface regions adapted for treating brushes and applicators of different sizes and configurations, and is adjustable between two different working configurations. One or more components of the adjustable device can be made of flexible materials such as silicone, or other suitable polymer materials.

The adjustable device provides the user with flexibility in treating cosmetic brushes and similar applicators. For example, a single device or a system of such devices can be configured for use both in a user's hand, and on a work surface. This flexibility accommodates brush sizes and designs that are better suited to treatment by motion along selected textures when the device is held in or worn on a user's hand, and other brushes sizes and designs that are better suited to treatment when the device is placed on a work surface. The flexibility enables the user to select the most comfortable and convenient way to treat brushes depending on their current location or their personal preference.

Figure 1:
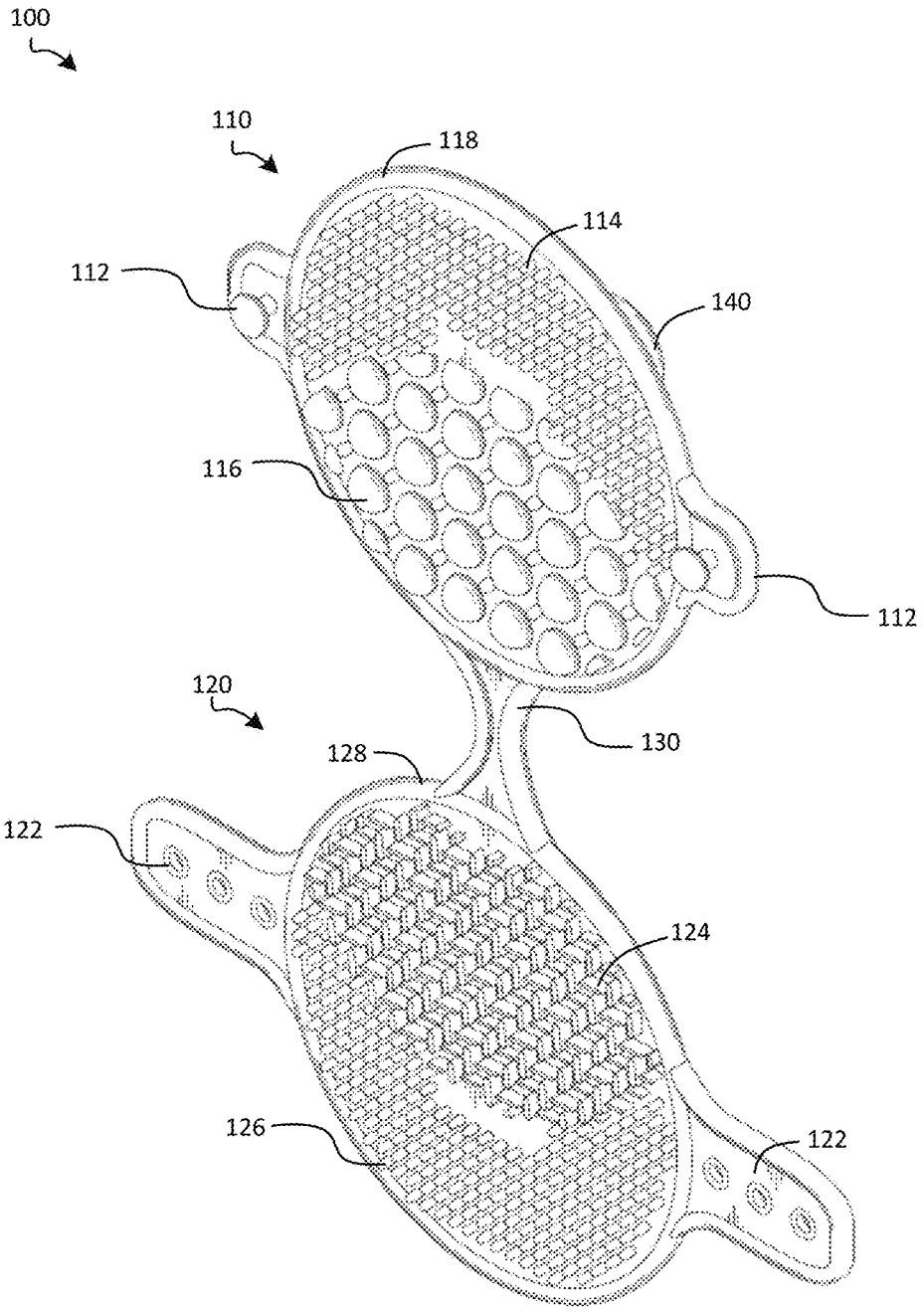
FIG. 1 is a perspective view of an adjustable device for treating cosmetic brushes and similar applicators.
Figure 2:
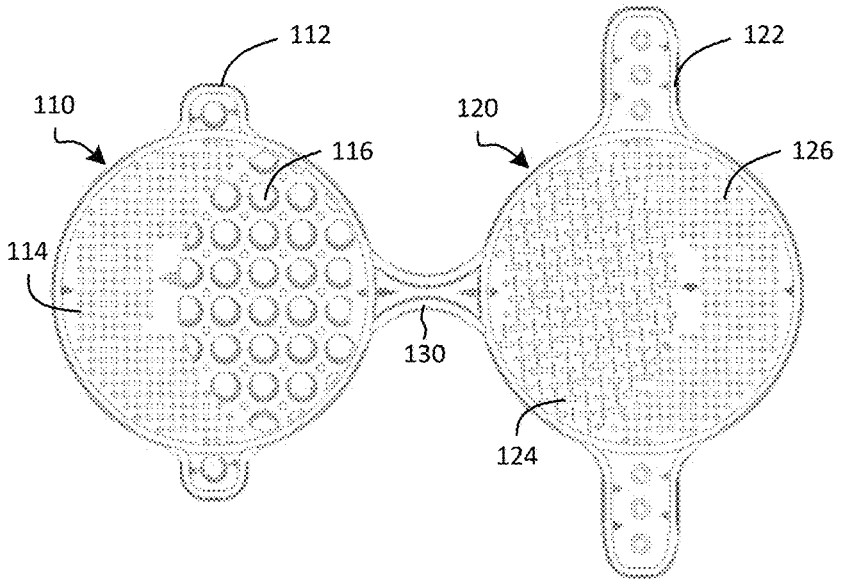
FIG. 2 is a top view of the adjustable device.
Figure 3:
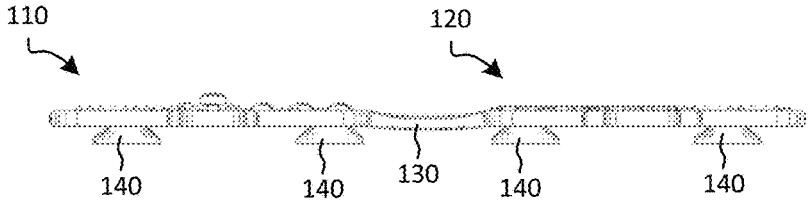
FIG. 3 is a side view of the adjustable device.
Figure 4:
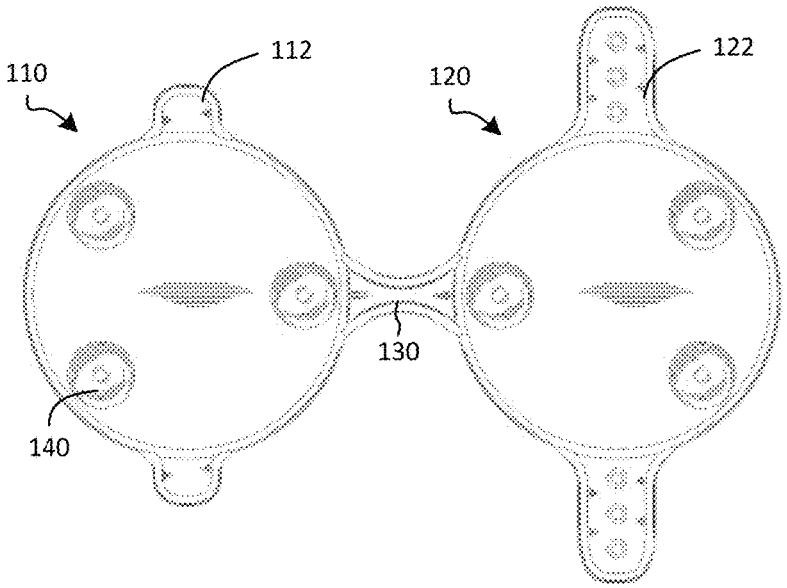
FIG. 4 is a bottom view of the adjustable device.

FIG. 1 is a perspective view of an adjustable brush treatment device 100, as described herein. FIG. 2 is a top view of device 100, and FIGS. 3 and 4 are side and bottom views of device 100, respectively.

FIGS. 1-4 illustrate device 100 in a first working configuration, suitable for use in a sink or basin, or on another working surface. The device 100 includes two or more lobes or textured surface portions, illustrated here as a first lobe 110 and a second lobe 120. The lobes 110, 120 are connected by a flexible attachment or coupling member 130, which extends between the two lobes 110, 120. A rim 118 borders the first lobe 110 and the second lobe 120.

The first lobe 110 includes one or more first coupling members 112, extending laterally from first lobe 110 and configured or adapted for coupling to a complimentary member 122 on the second lobe or textured portion 120. Alternatively, coupling members 112 and 122 can be provided with complementary features adapted for coupling on opposites of individual lobes 110 and 120.

The first lobe 110 includes one or more textured surface regions adapted for cleaning, rinsing or treating brushes and other applicators, illustrated here as a first textured surface region 114 and a second textured surface region 116. The second lobe 120 includes one or more additional textured surface regions adapted for cleaning, rinsing or treating the brushes and applicators, illustrated here as a third textured surface region 124 and a fourth textured surface region 126. The second lobe 120 also includes one or more second coupling members 122, adapted for coupling to one or more complementary members 112 on the first lobe 110.

Coupling members 112, 122 utilize a variety of different mechanical coupling structures, suitable for complementary couplings between lobes 110 and 120. For example, the first coupling member 112 can include coupling protrusions, extensions or similar structural features insertable into complementary openings or apertures defined in the second coupling member 122, thereby coupling the two members 112, 122 together. Other suitable coupling features and techniques can also be used, including but not limited to buttons, hooks, hook-and-loop fasteners, clasps, buckles, knots, magnets, snaps, mushroom-shaped coupling features, pin-shaped features other coupling structures, or combinations thereof.

The coupling members 112, 122 each include one or more extensions or tabs extending from lobes 110, 120, respectively. The coupling members 112 extend parallel to the coupling members 122 and generally perpendicularly to a longitude of flexible attachment 130. The coupling members 112, 122 are adapted to connect with one another when the device 100 is brought into the second working configuration (e.g., when worn on a user's hand or coupled about a post or other object). The coupling members 112, 122 are adjustably couplable such that the device 100 can be adjusted for differently sized or shaped hands (and other working configurations), depending on how the members 112, 122 are connected. For example, as illustrated here, the second coupling members 122 define multiple different openings into which one or more selected protrusion on the first coupling member 112 can be fit, so as to provide adjustability in size and tightness as desired. The user can thus adjust the configuration of the device 100 to fit the user's individual hand, or other particular working configuration.

The textured surface regions are regions on which textures adapted for treating brushes, brush heads and other applicators are disposed. Textures suitably adapted for treating different bush, brush head and applicator designs include a variety of both directionally neutral and directionally oriented textures. A directionally oriented texture is a texture adapted to accommodate movement of a brush head or applicator with a characteristic resistance in one particular direction (e.g., along a longitudinal dimension of a plurality of extended texturing features), and to accommodate movement of the brush head or applicator in other directions with substantially different characteristic resistance (e.g., transverse, orthogonal to, or perpendicular with respect to the longitudinal dimension). In some examples, the directionally oriented textures are adapted to accommodate back and forth motion in a predetermined or preferred direction with respect to the textured surface (e.g., either along across the respective directionally oriented features), and to accommodate motion in other directions with a different characteristic resistance, e.g., transverse to the back-and-forth direction, or in other directions which are not predetermined or preferred.

A directionally neutral texture is a texture adapted to accommodate more than one preferred direction of movement, or to accommodate movement substantially equally in multiple directions (or substantially all directions). In some examples, the directionally neutral texture is adapted to accommodate circular or swirling motion of the cosmetic brush head or other applicator, when engaged with and moved along or over the respective texture features. In other examples, the directionally neutral texture is adapted to accommodate movement of the brush head or applicator substantially equally in a number of different transvers or even mutually perpendicular (orthogonal) directions, or in substantially all different directions, as defined along the textured surface.

The texture surfaces can each include one or more different texturing patterns or features. For example, one textured surface region 114 includes a plurality of bristle features extending from the surface of region 114, forming a directionally neutral bristle texture. Another textured surface region 116 includes a plurality of intermingled nodule features extending from the surface of region 116, where the nodules may all be substantially similar, or have different (e.g., first and second) sizes or configurations adapted to form a directionally neutral texture.

A third textured surface region 124 includes ridge or bar features oriented in two or more different directions to form a substantially directionally neutral texture (e.g., with different transverse, orthogonal or perpendicularly orientated ridges or bars). A fourth textured surface region 126 includes a plurality of additional bristle features extending from the surface of region 126, also forming a directionally neutral texture.

Suitable textured surface regions also include other texturing features, including but not limited to ridges, bars, peaks, valleys, rods, cones, pyramids, blades, loops, squares, circles, lumps, hoops, calderas and other regular or irregular features, and combinations thereof. The textures may extend from or into the surface of the respective textured surface regions, in various suitable examples and configurations.

The rims 118, 128 are raised borders of the lobes 110, 120. The rims 118, 128 extend around the perimeter or periphery of each lobe 110, 120. The rims 118, 128 provide increased strength and durability for the lobes 110, 120. In an example, the rims 118, 128 are raised relative to the textures of the lobes 110, 120 and are configured to retain water or conditioning solution within the surface area of the lobes 110, 120 for use with the texturing features disposed within the raised border.

Each device 100 includes front and back surfaces. The front surface is generally the surface on or at which the textured surface regions are disposed, and along which the brushes or applicators are engaged to be treated. For example, the front surface of the device 100 is the surface visible in FIG. 2, and the back surface is on the opposite side of device 100, visible in FIG. 4. In other examples, there may be textures on both the front surface and the back surface of a device 100, and the front of the device 100 may be defined as the surface having textures that a particular user has selected for use.

During use, the back surface can thus be defined as the surface facing the user's hand or work surface. For example, the work surface is typically a location where the user will use the device 100 to treat brushes, such as a basin or sink, or on a countertop. The back surface of the device 100 includes one or more engagement features 140 suitably adapted to engage the work surface. In some examples, the features 140 include suction cups configured as an interface for suction engagement between the bottom surface of the device 100 and the work surface. In other examples, the engagement features 140 include handles, protrusions, skid-resistant members or other features suitably configured to hold the device 100 in place on the work surface, or to make the device 100 easier to control when held engaged with a user's hand.

The device 100 is configured to be adjustable between a first working configuration and a second working configuration. In the first working configuration, the device 100 is configured for placement on a work surface for treating brushes with a texturing feature exposed and available for use. In one example, the first working configuration is a generally flat configuration, as shown in FIGS. 1-4.

In the first working configuration, the textured surface regions (or front surfaces) of the first and second lobes 110, 120 face generally in the same direction. In these examples, a normal to the front of first lobe 110 (or to a plane tangent to the front surface of first lobe 110) and a normal to the front of the second lobe 120 (or to a plane tangent to the front surface of the second lobe 120) are oriented in generally the same or similar directions, with the device 100 in the first working configuration.

In the second working configuration, the textured surface regions (or front surfaces) of the lobes 110, 120 generally face in opposite directions. In these examples, a normal to the front of the first lobe 110 (or to a plane tangent to the front surface of first lobe 110) and a normal of the front of the second lobe 120 (or to a plane tangent to the front surface of the second lobe 120) are oriented in generally different or opposite directions, with the device 100 is in the second working configuration.

Figure 5:
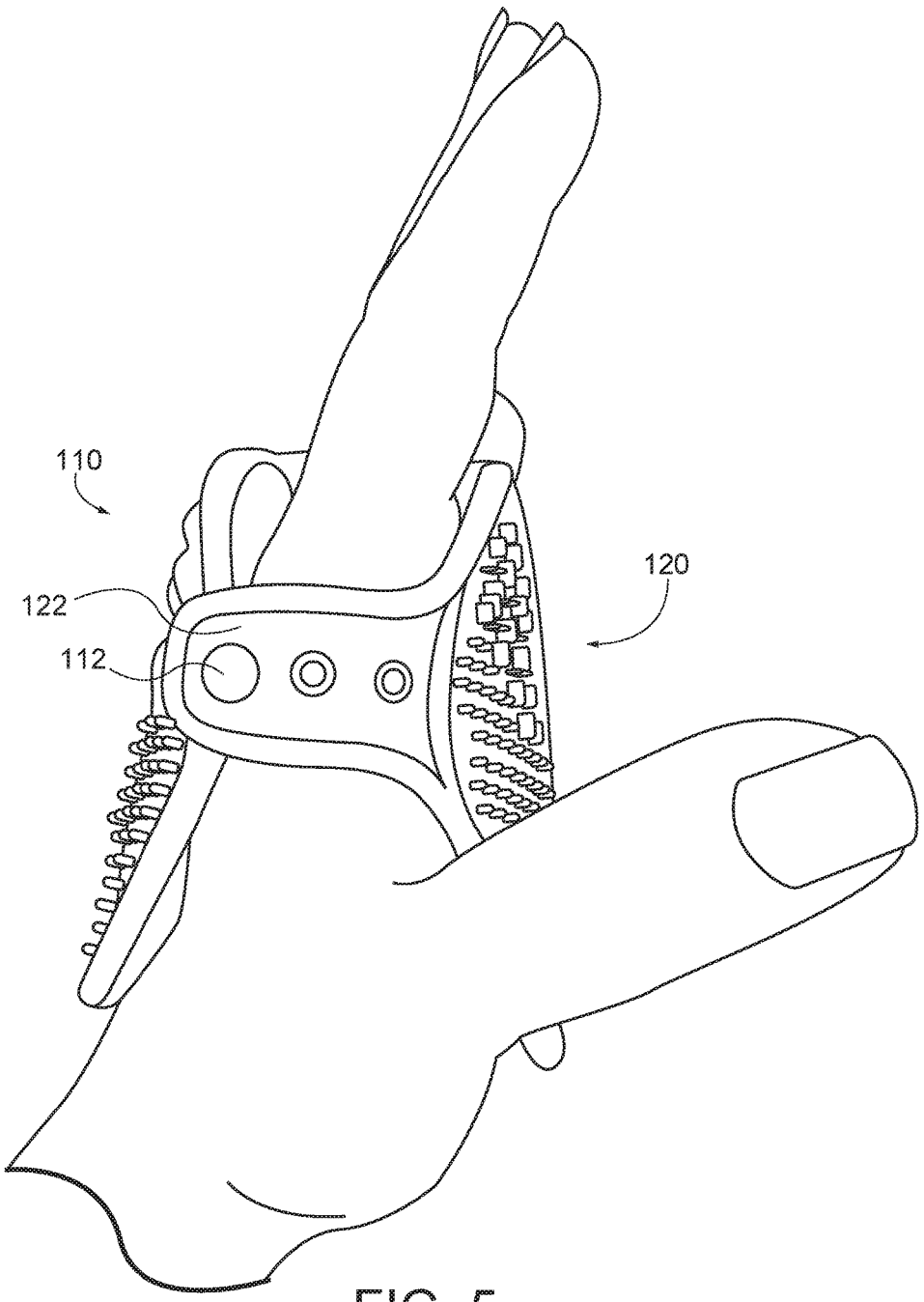
FIG. 5 illustrates a side view of the adjustable device configured for use on a user's hand.
Figure 6:
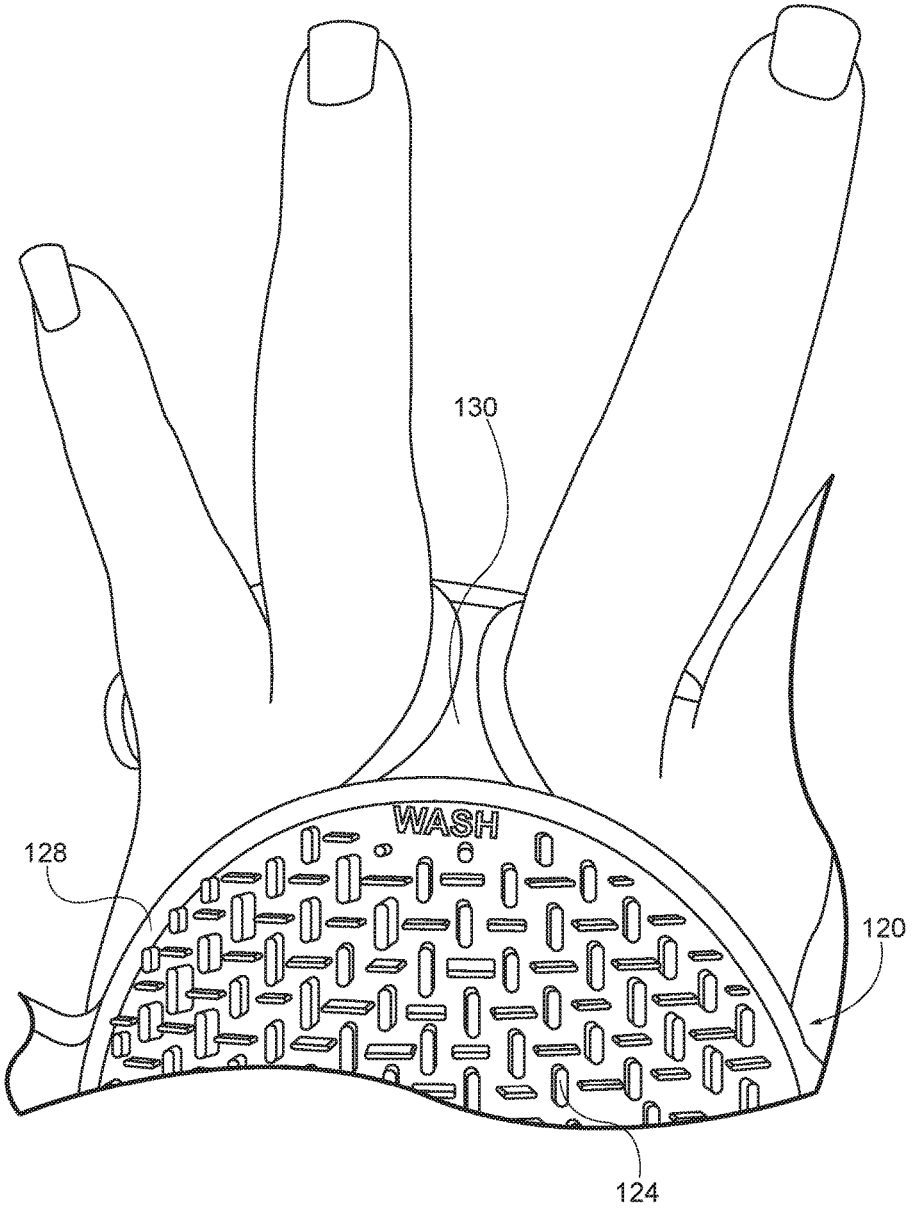
FIG. 6 illustrates a rear view of the adjustable device configured for use on the user's hand.

FIG. 5 illustrates a side view of the device 100 engaged with a user's hand, in the second working configuration. FIG. 6 illustrates rear view of the device 100 engaged with the user's hand in the second working configuration.

In this configuration, the device 100 is adapted to be worn on or held by the user's hand, or on or about a handle, post or other structure, with one or more textured surfaces available for use on either side. For example, in this second configuration the coupling members 112, 122 can be coupled so the device 100 defines a pocket, space, opening, or other region between lobes 110, 120, into which the user's right or left hand (or another object) can be inserted as shown in FIG. 5. Alternatively, the device 100 can be disposed about the user's hand first, with textured portions or lobes 110, 120 disposed on either side, and then presented in the second configuration by coupling members 112, 122 together. When worn on the user's hand, the lobes 110, 120 and/or the textured portions of the lobes 110, 120 are disposed over the palm and back of the user's hand, providing support for treating brushes.

In other examples, the second working configuration of device 100 defines a shape or geometry by which the user can hold the device, such as in the palm of the user's hand or on a handle, post or other object. The user can thus bring the device 100 from its first working configuration to its second working configuration by folding, bending, or otherwise manipulating the lobes 110, 120 of the device 100 about the flexible attachment 130, and coupling or uncoupling the corresponding straps or other coupling members 112, 122.

The device 100 can be held in the second working configuration when the first and second coupling members 112, 122, are engaged, for example as shown in FIG. 5. The flexible attachment 130 deforms as the device 100 is brought into the second working configuration. In one example, the attachment 130 is sufficiently stiff or flexible to hold either its deformed or original shape, thereby maintaining the device 100 in either the first or second working configuration. The flexible attachment 130 can also be adapted to fit between the fingers of the user's hand, for example by providing a curved profile, providing an hourglass shape, providing a thin shape, providing holes through which fingers may be inserted, or otherwise being shaped or adapted to accommodate the adjacent fingers (including between the thumb and the index finger, or any other adjacent fingers). When the device 100 is worn on the user's hand with the flexible attachment 130 between the fingers of the user's hand, the flexible attachment 130 resists the device 100 sliding down the user's hand. Additionally, in an example where the device 100 is worn on the user's hand with the flexible attachment 130 between the fingers of the user's hand and the first and second coupling members 112, 122 engaged, the device 100 provides stability during treatment of brushes.

In some examples, the device 100 has textures on both its front surface and back surfaces. The textures on the back can provide skid-resistance, so the device 100 resists sliding when engaged with a working surface. In these examples, the device 100 has a flattened shape in the first working configuration and is adapted to be folded to form a three-dimensional shape in the second working configuration, such as a generally cylindrical shape, or in the general form of a cube, cuboid, sphere, star, heart, pyramid, cone, prism, or other three-dimensional shape, or a combination of such shapes.

In additional examples, the lobes 110, 120 each have a particular shape or geometry, such as circular, ovoid, rectangular, elongate, square-shaped, star-shaped, heart-shaped, flower-shaped, animal-shaped or otherwise, or a particular combination thereof. The lobes 110, 120 may also be generally flat, concave, or convex. In some examples, the lobes are three-dimensional and include contoured curves, peaks, valleys, troughs, or other shapes.

Figure 7:
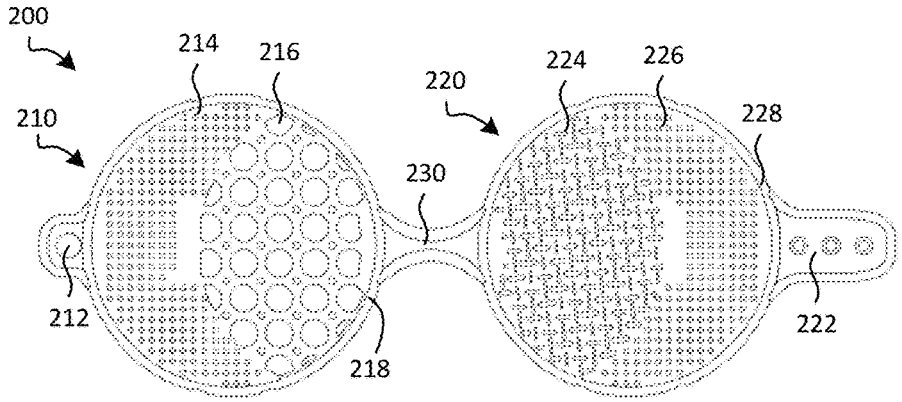
FIG. 7 illustrates an adjustable brush treatment device in a first alternate configuration.

FIG. 7 illustrates an adjustable brush treatment device or apparatus 200 that includes one or more features of the device 100, as described herein. The device 200 includes a first lobe 210 connected to a second lobe 220 by a flexible attachment 230. The first lobe 210 includes a first coupling member 212, a first textured surface region 214, a second textured surface region 216, and a rim 218. The second lobe 220 includes a second coupling member 222, a third textured surface region 224, a fourth textured surface region 226, and a rim 228. The first coupling member 212, the second coupling member 222, and the flexible attachment 230 are aligned with each other along an axis.

Figure 8:
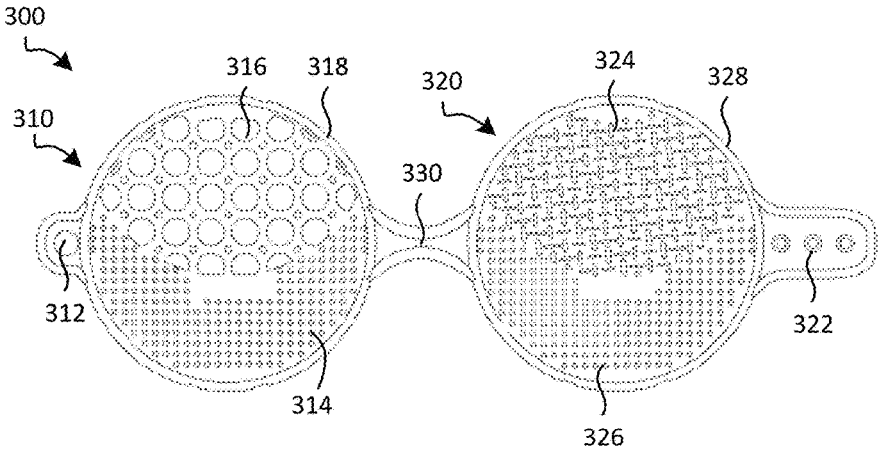
FIG. 8 illustrates an adjustable brush treatment device in a second alternate configuration.

FIG. 8 illustrates an adjustable brush treatment device or apparatus 300 that includes one or more features of the devices 100, 200 as described herein. The device 300 includes a first lobe 310 connected to a second lobe 320 by a flexible attachment 330. The first lobe 310 includes a first coupling member 312, a first textured surface region 314, a second textured surface region 316, and a rim 318. The second lobe 320 includes a second coupling member 322, a third textured surface region 324, a fourth textured surface region 326, and a rim 328. The first coupling member 312, the second coupling member 322, and the flexible attachment 330 are aligned with each other along an axis.

Figure 9:
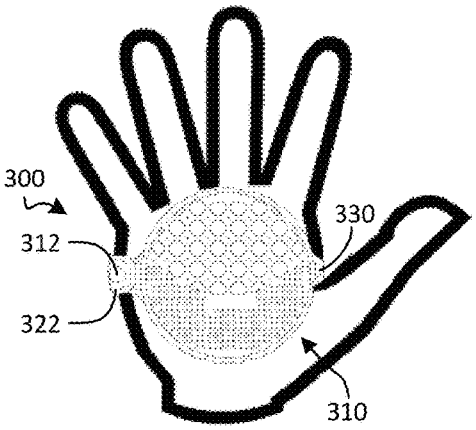
FIG. 9 illustrates the adjustable brush treatment device in the second alternate configuration worn on a user's hand.

FIG. 9 illustrates the device 300 arranged on the user's hand with the first coupling feature 312 coupled with the second coupling feature 322. As illustrated in FIG. 9, the lobe 310 overlies the back of the user's hand. The user can adjust the device 300 so the lobe 320 overlies the back of the user's hand by shifting the device 300 around the hand without uncoupling the coupling members 312, 322.

Figure 10:
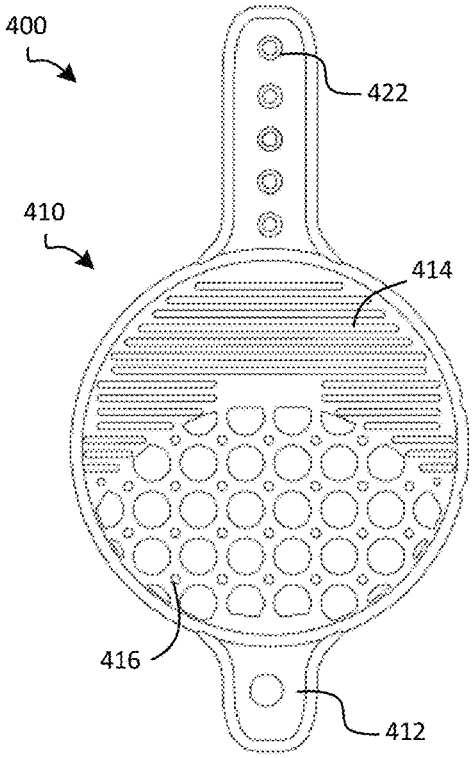
FIG. 10 is a top view of the adjustable device in a third alternate configuration.

FIG. 10 illustrates an adjustable brush treatment device or apparatus 400 that includes one or more features of the devices 100, 200, 300, as described herein. The device 400 includes a lobe or textured surface portion 410 having a first coupling feature 412 and a second coupling feature 422, each extending laterally from lobe portion 410 (e.g., on opposite sides as shown). The surface of lobe 410 includes a first textured surface region 414 and a second textured surface region 416.

In this example, the first textured surface region 414 includes a plurality of elongate bar or ridge features extending from the surface of first textured surface region 414 and forming a directionally oriented texture. The second textured surface region 416 includes a plurality differently-sized nodule features extending from the second textured surface region 416. Other directionally neutral and directionally oriented texture patterns are also suitable, as described herein.

A user can bring the device 400 from a first working configuration (e.g., on a sink or basin surface) into a second working configuration by coupling the first and second coupling members 412, 422 of the lobe 410 to form a strap or opening, through which a user's hand may be inserted. Alternatively the user can arrange the device 400 with selected textures on the front or back side of the hand, and then couple the straps or other members 412, 422 together.

Figure 11:
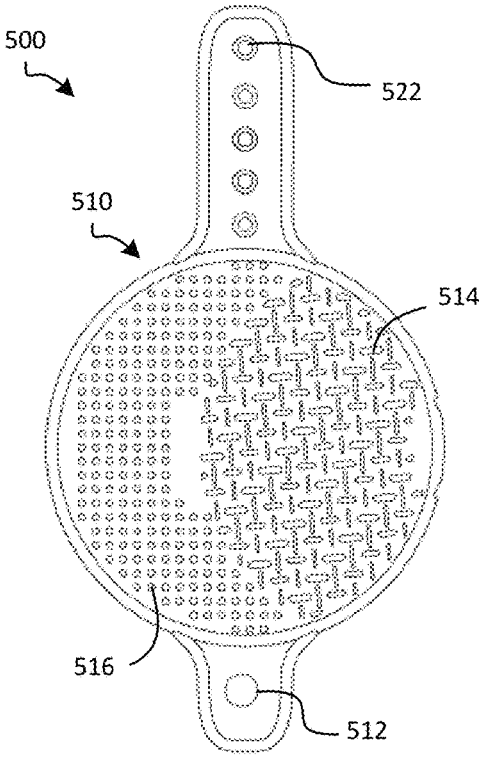
FIG. 11 is a top view of the adjustable device in a fourth alternate configuration.

FIG. 11 illustrates an adjustable brush treatment device or apparatus 500 that includes one or more features of a device 100, 400, as described herein. In this example, the device 500 includes a lobe or textured surface portion 510 having a first coupling feature 512 and a second coupling feature 522, each extending laterally from lobe 510.

The surface of lobe 510 also includes a first textured surface region 514 and a second textured surface region 516, for example including one or more directionally oriented or directionally neutral textures. The user may bring the device 500 from a first (e.g., generally planar) working configuration into a second working configuration by coupling the first and second coupling features 512, 522 of the lobe 510 to form a strap or opening through which a user's hand may be inserted.

The user can form an adjustable brush treatment system by coupling multiple devices 100, 400, 500 together. For example, the user may select two or more adjustable brush treatment devices 400 and 500 having selected texture features, and couple the devices together to form a single adjustable brush treatment apparatus or system. The individual brush treatment textures can be selected or adapted for treating particular kinds of brushes, or other cosmetic applicators. In some examples, the textures on the exposed surfaces of the brush treatment device are adapted to wash, rinse, shape, refine, dry, or otherwise treat a cosmetic brush, sponge, or other applicator. In additional examples, a kit having multiple different adjustable treatment devices is provided, each having at least one selected texture characteristic (e.g., adapted for rinsing, washing or drying; adapted for smaller eye brushes or larger face brushes, etc.). Thus the user can select two or more devices with different textures, and combine them to form a desired treatment system.

Figure 12:
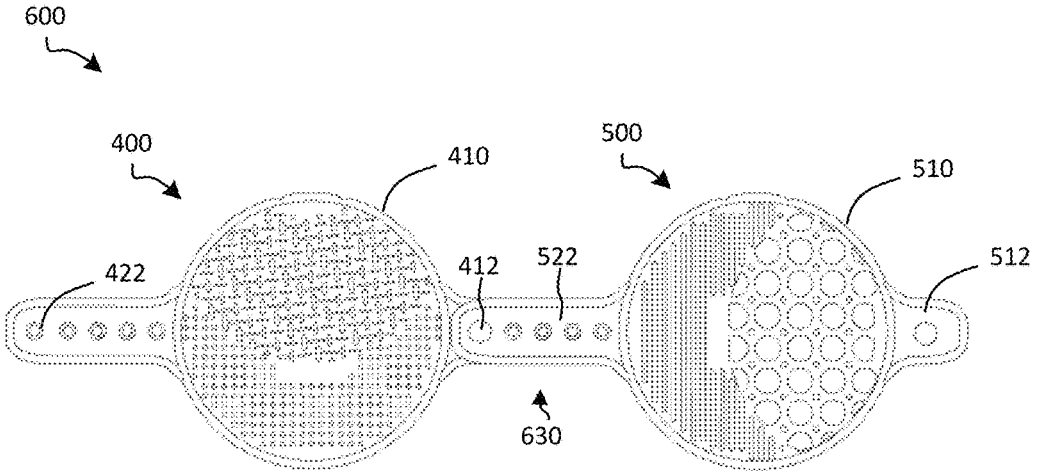
FIG. 12 is a top view of an adjustable brush or applicator treatment system including two or more individual textured devices.

FIG. 12 illustrates a system or apparatus 600 formed by coupling the first coupling feature 412 of device 400 with the second coupling feature 522 of device 500. In this particular example, system 600 includes two lobes 410, 510, which are coupled together with a flexible attachment 630.

The user can manipulate or reconfigure system 600 between the first (generally planar) working configuration and the second working configuration, for example by coupling the first coupling feature 512 of one device 500 with the second coupling feature 422 of the other device 400. The user can then treat brushes or applicators with the adjustable system 600 in one or both of the different working configurations, as described above for individual devices 100, 400 and 500.

In one such example, the treatment process begins with a user providing the device in either the first or second configuration, and using the device to treat one or more brushes or applicators. After presenting the device for use in one configuration, the user can manipulate or adjust the device to present the other configuration. For example, the user can adjust the device as configured for use on a work surface, into a device configured for use in or on the user's hand.

In these examples, the user can provide the device for use on a work surface or in a work area by adjusting the device to the first generally planar working configuration, with all the textured treatment surfaces exposed over the surface, and facing in generally the same direction. The device can also be provided in the second working configuration, with the textured treatment surfaces exposed and presented for use on opposite sides of the user's hand. The user can then manipulate the device from one working configuration to the other by bending or otherwise manipulating the device and coupling or uncoupling the straps or other coupling members.

With the device in the first working configuration, the user places the device on the work surface or in a work area. In this configuration, the device is placed such that the textured surfaces (e.g., on the front of the device) are exposed and presented for use on the same side of the work area, with the second, opposite surfaces (e.g., on the back of the device) facing the work surface.

In another example, the user configures the device by adjusting the textured portions to present the second working configuration. The second working configuration facilitates use of the device by making the device easier to hold or wear in or on the user's hand. For example, the user can place the device on his or her hand, and bend the flexible attachment between the fingers with the first and second lobes or textured portions on either side. The user can then engage selected complementary mechanical features on the respective coupling members, in order to hold the device in the second working configuration.

In this arrangement, the device defines an opening or a pocket into which the user's hand may fit, or be inserted. Alternatively the lobes can be disposed on either side of the user's hand first, and then coupled to together.

With the device in either desired configuration, the user can treat brushes and applicators on the respective textured surfaces. Suitable treatments include but are not limited to washing, rinsing, cleaning, cleansing, scrubbing, shaping and drying the brush with the textures and other features of the device. The user can manipulate the brush against or along selected textures as part of any of the treatment steps, depending on applicator size and configuration, and the desired treatment step. For example, the brush head or applicator can be engaged in a directionally oriented back and forth motion along the textured surface with preferred direction along or transverse to the corresponding texture features. Alternatively, the brush head or applicator can be engaged in a directionally neutral swirling or circular motion, where the engagement is substantially the same or similar in different directions along the textured surface.

While this disclosure describes a particular device in relation to treating makeup brushes, there are other suitable applications and configurations. The device can also be adapted to treat other applicator designs, including but not limited to cosmetic brushes, cosmetic sponges, shaving brushes, paint brushes, paint sponges and other applicator devices, and combinations thereof.

Although this disclosure is made in the context of certain methods and examples, the invention itself extends beyond these specifically disclosed embodiments to other alternative configurations and uses, and to additional modifications and equivalents thereof. Thus, the foregoing description should not be interpreted as limiting the scope of the present invention, which is defined by the following claims.

The invention claimed is:

1. An adjustable brush treatment device comprising:

first and second textured portions, each portion having a textured surface adapted for cleaning or rinsing a brush head and an opposite surface adapted for placement of the device in a working area, wherein the textured surfaces on each portion are exposed for engagement with the brush head in a first working configuration of the device;

an elongate substantially planar flexible attachment between the first and second textured portions, said flexible attachment defining an axis extending along a length thereof; and a pair of coupling members on opposite sides of each of the first and second textured portions, the coupling members of each textured portion being positioned on opposite sides of the axis defined by the flexible attachment, the coupling members adapted for coupling the device about a user's hand, wherein the textured surfaces on each portion are exposed for engaging the brush head on either side of the user's hand in a second working configuration of the device; and wherein the flexible attachment is adapted for positioning between adjacent fingers of the user's hand to resist sliding and provide stability during treatment of the brush head, with the coupling members coupled together in any of a plurality of locations to provide adjustability in size and tightness for the second working configuration of the device, disposed about the user's hand.

2. The adjustable brush treatment device of claim 1, wherein the flexible attachment comprises an hourglass shape adapted for positioning between the adjacent fingers of the user's hand with the first and second textured portions disposed on opposite sides thereof, in the second working configuration of the device.

3. The adjustable brush treatment device of claim 1, further comprising engagement features disposed on the opposite surface of one or both textured portions, the engagement features configured to engage a surface of the working area in the first working configuration of the device.

4. The adjustable brush treatment device of claim 1, the coupling members having a plurality of mechanical coupling features configured for selective sizing of the device when coupled about the user's hand in the second working configuration.

5. The adjustable brush treatment device of claim 1, wherein the textured surfaces of each portion are oriented in substantially a same direction with respect to the working area, with the device in the first working configuration.

6. The adjustable brush treatment device of claim 5, wherein the textured surfaces of each portion are oriented in substantially opposite directions with respect to the user's hand, with the device in the second working configuration.

7. The adjustable brush treatment device of claim 1, wherein the textured surface on the first portion comprises a plurality of directionally oriented features adapted for engagement with the brush head in a preferred direction and the textured surface on the second portion comprises a plurality of directionally neutral features configured for substantially equal engagement with the brush head in different directions.

8. The adjustable brush treatment device of claim 7, further comprising a raised border on each textured portion, the border comprising a raised feature extending about a periphery thereof.

9. The adjustable brush treatment device of claim 8, wherein the textured surfaces of the first and second portions each comprise a plurality of directionally neutral features and a plurality of directionally oriented features disposed within the raised border.

10. The adjustable brush treatment device of claim 1, wherein the coupling members extend at least partially around the user's hand when the device is positioned in the second working configuration.

11. The adjustable brush treatment device of claim 1, wherein the flexible attachment spaces the first and second textured portions away from each other.

12. A method comprising:

presenting an adjustable brush treatment device in a first working configuration, the device having first and second textured portions, each portion having a textured surface adapted for cleaning or rinsing a brush head and an opposite surface adapted for placement of the device in a working area, wherein the textured surfaces on each portion are exposed for engagement with the brush head in the first working configuration of the device, with the textured surfaces presented in a substantially same direction for engaging the brush head;

manipulating the first and second textured portions about an elongate substantially planar flexible attachment between the first and second textured portions, said flexible attachment defining an axis extending along a length thereof, wherein the device is presented in a second working configuration for engagement with a user's hand;

coupling the first and second textured portions together with a pair of coupling members on opposite sides of each of the first and second textured portions, the coupling members of each textured portion being positioned on opposite sides of the axis defined by the flexible attachment, the coupling members adapted for coupling the device about the user's hand;

wherein the textured surfaces on each portion are exposed for engaging the brush head on either side of the user's hand in the second working configuration of the device, with the textured surfaces presented in different directions for engaging the brush head on opposite sides of the user's hand; and wherein the flexible attachment is positioned between adjacent fingers of the user's hand in the second working configuration of the device to resist sliding and provide stability during treatment of the brush head, with the coupling members coupled together in any of a plurality of locations so as to provide adjustability in size and tightness for the second working configuration of the device, disposed about the user's hand.

13. The method of claim 12, further comprising engaging the brush head with one or both of the textured portions to clean and rinse the brush head with the device in the first working configuration and in the second working configuration.

14. The method of claim 12, further comprising selecting from among multiple complementary coupling features provided on the coupling members extending from the textured portions, wherein the device is adjusted for fit about the user's hand in the second working configuration.

15. The method of claim 12, wherein coupling the first and second textured portions together comprises forming an interior region therebetween, and further comprising inserting the user's hand into the interior region between the first and second textured portions.

16. The method of claim 12, wherein coupling the first and second textured portions together comprises coupling the portions together about the user's hand, wherein the user's hand is disposed therebetween.

17. An adjustable brush treatment device comprising:

first and second textured portions, each textured portion having a front textured surface adapted for cleaning or rinsing brush heads, an opposite back surface adapted for placement of the device in a working area, and a textured region disposed on the front textured surface, the textured region adapted for treating cosmetic brush heads;

an elongate substantially planar flexible attachment between the first and second textured portions, said flexible attachment defining an axis extending along a length thereof; and a pair of first and second coupling members attached to opposite sides of each of the first and second textured portions, the first and second coupling members of each textured portion being attached to each of the first and second textured portions on opposite sides of the axis defined by the flexible attachment, the coupling members adapted for coupling the device about a user's hand and presenting the device in different first and second working configurations;

wherein the brush treatment device is adaptable between:

a first working configuration in which the device is adapted for engagement with a work surface in the working area, wherein the front textured surfaces on each textured portion are exposed for engagement with the brush heads in the first working configuration of the device, with each of the front textured surfaces presented in a substantially same direction for engagement with the brush heads on a same side of the work surface; and a second working configuration in which the device is adapted for engagement with a user's hand, wherein the front textured surfaces on each textured portion are exposed for engaging the brush heads on either side of the user's hand in the second working configuration of the device, with the front textured surfaces presented in different directions for engagement with the brush heads on opposite sides of the user's hand; and wherein the flexible attachment is adapted for positioning between adjacent fingers of the user's hand to resist sliding and provide stability during treatment of the brush head, with the coupling members coupled together in any of a plurality of locations so as to provide adjustability in size and tightness for the second working configuration of the device, disposed about the user's hand.

18. The brush treatment device of claim 17, wherein the first and second coupling members are configured for uncoupling to present the device in the first working configuration, wherein the device is engaged with the work surface, and for coupling together to present the device in the second working configuration, wherein the device is engaged with the user's hand.

19. The brush treatment device of claim 17, wherein the first and second textured portions each comprise at least one directionally oriented texture configured for back and forth engagement with the brush heads in a preferred direction, and at least one directionally neutral texture configured for substantially equal engagement with the brush head in two or more different transverse directions.

20. The brush treatment device of claim 17, further comprising engagement features disposed on the back surface of at least one of the first and second textured portions, the engagement features configured to resist movement of the device when engaged with the work surface.

21. The brush treatment device of claim 17, wherein the flexible attachment comprises an hourglass shape configured for positioning between the adjacent fingers of the user's hand with the two textured portions disposed on opposite sides thereof, in the second working configuration of the device.

* * * * *